US005361418A

United States Patent [19]

Luzenske

[11] Patent Number: 5,361,418

[45] Date of Patent: Nov. 8, 1994

[54] SAFETY CARRY GARMENT

[76] Inventor: Frank J. Luzenske, 9 E. Monroe, Danville, Ill. 61832

[21] Appl. No.: 143,920

[22] Filed: Oct. 27, 1993

[51] Int. Cl.[5] ..... A41F 3/02

[52] U.S. Cl. ..... 2/338; 2/312; 2/69; 2/94; 128/874; 128/875; 128/876; 224/158; 441/80; 441/106

[58] Field of Search ..... 2/338, 311, 312, 318, 2/336, 228, 238, 69, 69.5, 94; 441/80, 106; 224/157, 158; 54/37.1, 44.1, 46, 47, 49; D3/31; 27/28; 297/464, 465, 467, 468; 128/869, 870, 873, 874, 875, 876, 846

[56] References Cited

U.S. PATENT DOCUMENTS

| | | | |
|---|---|---|---|
| 2,956,541 | 10/1960 | Rall . | |
| 3,896,499 | 7/1975 | Kelly | 2/311 |
| 4,258,440 | 3/1981 | McGowan . | |
| 4,308,629 | 1/1982 | Freemon . | |
| 4,429,419 | 2/1984 | Snyder | 2/311 |
| 4,449,253 | 5/1984 | Hettinger | 2/94 |
| 4,599,750 | 7/1986 | Rahaman . | |
| 5,065,773 | 11/1991 | Jackson | 2/338 |

*Primary Examiner*—Clifford D. Crowder
*Assistant Examiner*—Gloria Hale
*Attorney, Agent, or Firm*—Chase & Yakimo

[57] ABSTRACT

A safety device is disclosed which is worn by a person but does not interfere with movement of the limbs, and is provided with handles that may be grasped to assist in carrying, stabilizing or moving the person. A girdle-like device of cloth construction is worn about the waist and is formed by a flexible panel having a T-shaped configuration before application to the wearer. This configuration presents a pair of opposed arms which are brought about the waist and secured to form a band, and a single connecting element that extends front to rear under the crotch and is joined to the band.

8 Claims, 2 Drawing Sheets

SAFETY CARRY GARMENT

BACKGROUND OF THE INVENTION

This invention relates to improvements in safety devices for supporting a person in the water or during physical therapy and, in particular, to a girdle-like device of cloth construction which is worn but does not interfere with swimming or other body movement, and is provided with handles which may be grasped to assist in carrying, stabilizing or moving the person.

In teaching a person to swim or in training an accomplished swimmer for competition, there are times when the coach or instructor needs to grasp the student either for instructional purposes or to assist the swimmer if he or she has become exhausted in a training swim. Grasping the body, of course, is difficult, and harness-type devices previously proposed have not gained widespread acceptance. To be usable, any such device must not impede the normal movements of the swimmer nor significantly reduce his or her efficiency, and yet must provide a means by which another person can provide effective assistance.

Also, patients in physical therapy must frequently be supported or stabilized by another during the course of therapy. The same problem is presented in providing a garment that can be worn but does not interfere with the requisite body movement, and yet provides a means by which an assistant can effectively grasp and hold the patient.

SUMMARY OF THE INVENTION

It is, therefore, the primary object of the present invention to provide a safety device which is worn by a person but does not interfere with the desired body movement, and which provides a means by which another person can assist in carrying, stabilizing or moving the wearer.

As a corollary to the foregoing object, it is an important aim of this invention to provide such a device constructed of flexible cloth or the like that is worn about the waist, embraces the hips, and is provided with a connecting element extending from front to rear under the crotch and that, therefore, is convenient to wear and does not interfere with normal movement of the limbs.

Another important object of the invention is to provide such a device upon which handles, preferably of cloth construction, are secured for easy grasping by a person who would assist the wearer.

Still another important object of the invention is to provide a safety device in the form of a piece or panel of flexible cloth or the like of T-shaped configuration that, upon application to a wearer, provides a band worn about the waist and hips of the wearer and a connecting element as aforesaid which is releasably secured to the band to hold the device in place and yet permit it to be easily removed.

Yet another important object of this invention is to provide a T-shaped device of flexible material which presents a pair of opposed arms extending outwardly from a junction with a central connecting element that is generally perpendicular to the arms, the outer ends of the arms and the element being provided with fastening means for releasably securing the ends of the arms together about the waist of a wearer to present a band around the waist and hips, and the connecting element being brought under the crotch and up to a position united with the band, the device being otherwise devoid of connecting straps, braces or fasteners which would interfere with normal movement of the limbs of an active person. The band provides a base to which flexible handles are attached that may be conveniently grasped by a person in assistance.

Furthermore, it is an important object of this invention to provide such a device which, in its preferred form, forms a band around the body of sufficient width to also wrap around the chest of the wearer in addition to the waist and hips, thereby providing additional support and handles to assist another person in grasping and controlling the wearer.

Other objects will become apparent as the detailed description proceeds.

DETAILED DESCRIPTION

Figure 1:
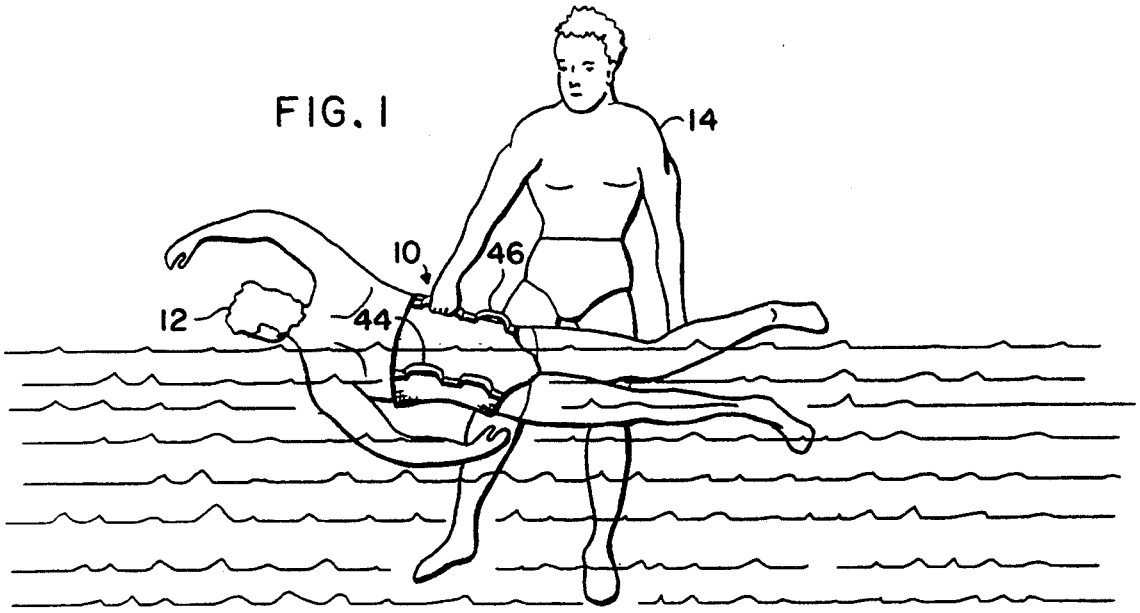
FIG. 1 illustrates the present invention on a swimmer who is being assisted by an instructor.
Figure 2:
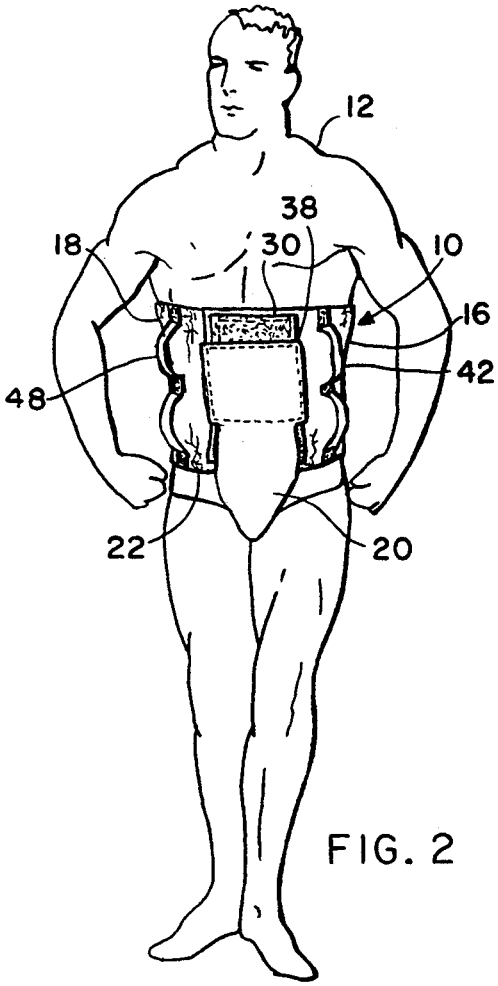
FIG. 2 is a front view showing the device secured in place on the wearer.
Figure 3:
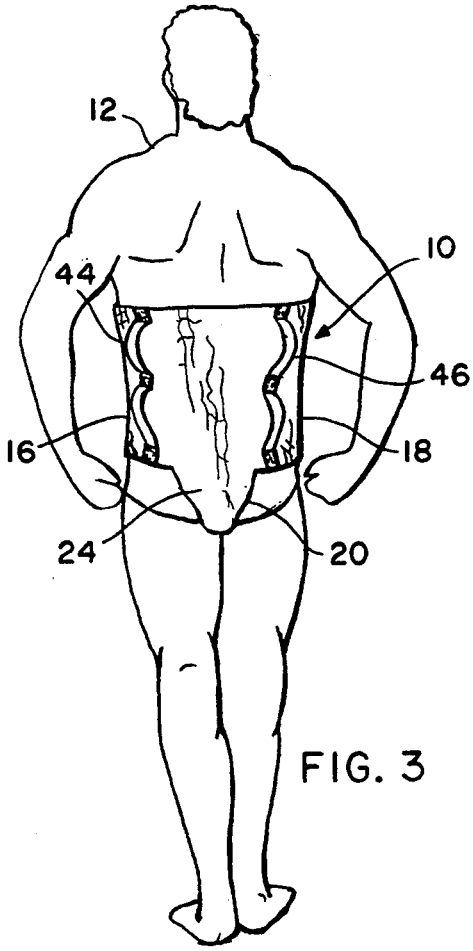
FIG. 3 is a rear view of the device of FIG. 2, as worn.

FIGS. 1–3 illustrate the safety carry device 10 of the present invention as worn, the individual illustrated being a swimmer 12 assisted by an instructor 14. The device 10 is best understood by initial reference to FIGS. 4 and 5 which show it removed from the individual and opened to a flat condition. As may be appreciated from viewing FIGS. 4 and 5, the device 10 has a T-shaped configuration and thus presents opposed, left and right arms 16 and 18 (as viewed in FIG. 4) and a central element 20 that extends perpendicularly from the arms 16, 18. The material utilized for the arms 16, 18 and element 20 is a piece of suitable fabric, such as a heavy mesh cloth or canvass type material, which is durable and yet flexible and comfortable to wear. A unitary piece of material may be used as shown, or individual segments may be stitched together to form the T-shaped panel configuration. It should be noted that the inner end of element 20 is joined with arms 16, 18 along a longitudinal edge 22 at a central junction 24, the edge 22 presenting the lower edge of the arms 16, 18 when the device is worn. Accordingly, arms 16 and 18 are of substantially equal length on each side of the junction 24 with the perpendicularly extending element 20.

Figure 5:
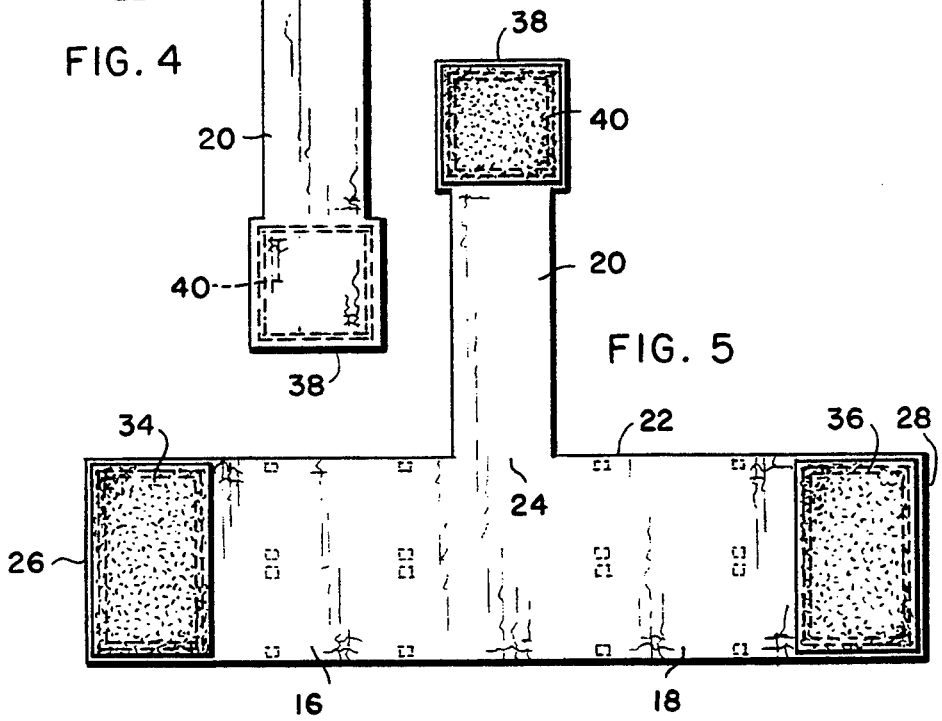
FIG. 5 is a bottom view of the device seen in FIG. 4.

Arms 16 and 18 have outer ends 26 and 28 respectively. A VELCRO hook and loop fastener 30 is secured to end 26 by stitching or the like, and a VELCRO hook and loop fastener 32 is likewise attached to the other end 28. Referring to FIG. 5, VELCRO hook and loop fasteners 34 and 36 are likewise secured to the opposite side of arms 16 and 18 at ends 26 and 28, respectively, the side of the panel seen in FIG. 5 being the inside thereof when worn. Element 20 has an outer end 38 provided with a VELCRO hook and loop fastener 40 on its inner side only as seen in FIG. 5.

Figure 4:
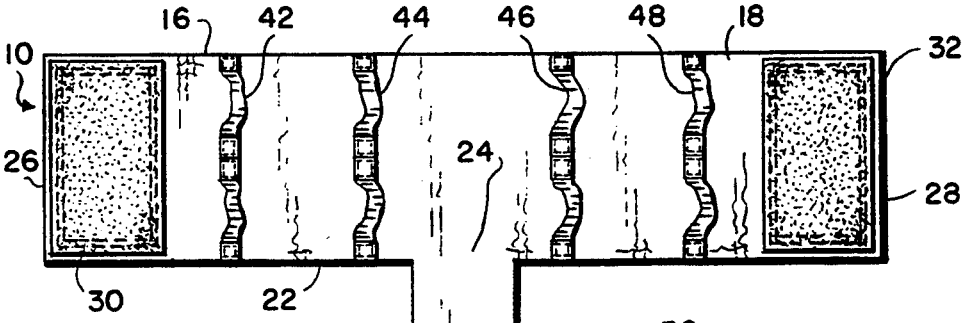
FIG. 4 is a plan view of the device seen in FIGS. 1–3 removed from the wearer and laid flat in a horizontal plane.

Four pairs of cloth handles 42, 44, 46 and 48 are secured by stitching or the like on the outer side of arms 16, 18 as seen in FIG. 4. Each pair of handles is disposed in end-to-end relationship across the respective arm, the two pairs of handles 42 and 44 being spaced from each other and from junction 24 on arm 16, and the pairs of handles 46 and 48 being similarly located on arm 18.

Figure 6:
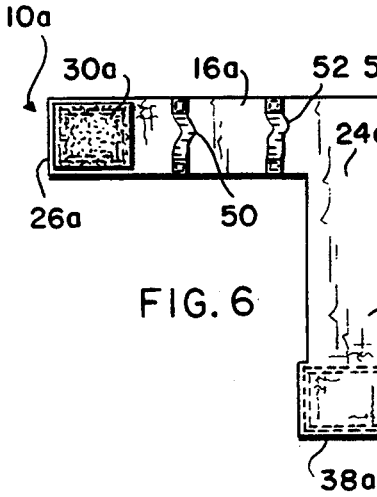
FIG. 6 is a plan view similar to FIG. 4 of a modified form of the present invention which principally embraces the hips of the wearer.
Figure 7:
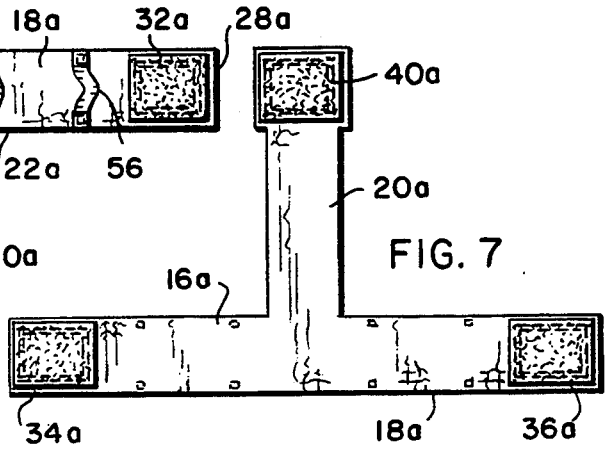
FIG. 7 is a bottom view of the device shown in FIG. 6.

FIGS. 6 and 7 show a modified form of the present invention, corresponding components bearing the same reference numerals with the addition of the "a" notation. The difference between the device 10*a* and the preferred embodiment of FIGS. 4 and 5 is that the arms 16*a*, 18*a* are of lesser width. As will be appreciated with reference to FIGS. 1–3, arms 16*a*, 18*a* would extend about the waist of the wearer and embrace the hips but would not wrap around the chest of the wearer. Single cloth handles 50, 52, 54 and 56 are employed in the same locations as the double handles 42, 44, 46 and 48 respectively in FIG. 4.

In use, the arms 16 and 18 are brought around the waist of the wearer (such as the swimmer 12 in FIGS. 1–3) and their ends 26, 28 are overlapped to bring the hook and loop fasteners into mating engagement. In this respect, it should be understood that the rectangular pieces of fastener material 30 and 32 on the outside of the arms 16 and 18 are one type of VELCRO component (either hooks or loops) whereas the material 34 and 36 on the inside surfaces of the arms 16 and 18 is of the opposite type. Therefore, the manner of overlapping the ends of the arms is immaterial; in the illustration in FIG. 2 the left arm 16 overlaps the front side of the end of the right arm 18.

The arms 16 and 18 of the embodiment of FIGS. 4 and 5, once the ends thereof are overlapped and secured as in FIG. 2, present a band encircling the waist and hips of the wearer. Furthermore, the arms 16 and 18 are of sufficient width to also wrap around the lower portion of the chest as is clear in FIG. 2. To complete installation of the device, element 20 is brought between the legs and under the crotch to the position as illustrated (FIG. 2) where end 38, provided with fastener 40, is secured to the mating material 30 on the outer side of arm 16. The material in fastener 40, therefore, is compatible with either of the outer fasteners 30 or 32 on the arms 16, 18. It will be appreciated that, once in place, the united arms or band 16, 18 and element 20 cooperate to hold the device on the wearer without interfering with movement of the limbs of an active person, such as the swimmer 12. In this respect, it should also be noted that only the single connecting element 20 is employed in the present invention as an attachment to the band extending front to rear, the device 10 being otherwise devoid of connecting straps, braces or fasteners of any type which would interfere with movement of the limbs.

The handles 42–48 are positioned for convenient grasping by an individual assisting the swimmer 12, as illustrated in FIG. 1 which shows the instructor 14 grasping one of the handles 46 at the right rear of the swimmer 12. Handles 44 are similarly positioned rearwardly of the hips on the left side of the swimmer 12, and the handles 42 and 48 are located in front of the hips on the left and right sides, respectively (not shown).

Utilization of the embodiment of FIGS. 6 and 7 is similar to that described above for the embodiment of FIGS. 4 and 5, the difference being that the flexible strip presented by the arms 16*a* and 18*a* is of lesser width and thus encircles the waist and embraces the hips but does not extend into the chest. Single handles 50–56 are provided at the same locations forwardly and rearwardly of the individual's hips as described above.

Accordingly, the present invention provides a safety device which may conveniently worn and which materially assists in carrying, stabilizing or moving the wearer as the handles may be readily grasped by another and the body thus assisted or controlled.

Having thus described the invention, what is claimed as new and desired to be secured by Letters Patent is:

1. A safety device to aid in carrying, stabilizing or moving a person comprising:

a strip of flexible material adapted to be worn about the waist of a wearer and having sufficient width to extend over and embrace the hips, said strip being provided with a pair of ends and means for releasably securing said ends together to present a band encircling a wearer, a single connecting element of flexible material cooperating with said band to resist shifting thereof when worn and hold the band on a wearer, said single connecting element having opposed ends and being adapted to extend front to rear under the crotch of a wearer, one of said ends thereof being joined to said band, means for releasably attaching the opposite end of said element to said band, and a plurality of handles on said band at the sides of a wearer for grasping by another person so that the wearer may be easily carried, stabilized or moved.

2. The device as claimed in claim 1, wherein said strip is of sufficient width to wrap around the chest of a wearer in addition to said waist and hips.

3. A safety device to be worn so that another person can assist in carrying, stabilizing or moving the wearer, said device comprising:

a panel of flexible material having a T-shaped configuration before application to a wearer and presenting a pair of opposed arms extending outwardly from a junction with a central element that is generally perpendicular to the arms, said arms having respective outer ends provided with means for releasably securing said ends together to present a band adapted to be worn about the waist of a wearer, said element having an outer end provided with means for releasably attaching said end of the element to said secured ends of the arms whereby, when worn, the element is adapted to extend under the crotch of a wearer and cooperate with the band to hold the safety device on the wearer, and a plurality of handles on said arms secured thereto between said junction and said ends of the arms.

4. The device as claimed in claim 3, wherein said plurality of handles comprise at least four handles spaced from one another, a pair thereof being disposed on each of said arms.

5. The device as claimed in claim 3, wherein each of said handles is composed of flexible material.

6. The device as claimed in claim 3, wherein said arms are elongated and have a transverse dimension sufficient to extend over and embrace the hips of a wearer when the safety device is worn.

7. The device as claimed in claim 6, wherein said transverse dimension is sufficient to extend over and embrace a lower portion of the chest of a wearer when the safety device is worn.

8. The device as claimed in claim 7, wherein said plurality of handles include a plurality of pairs of handles spaced along said arms between said junction and said ends thereof, each of said pairs comprising handles composed of flexible material disposed in end-to-end relationship transversely of said arms.

* * * * *